US005145355A

United States Patent [19]

Poinsot et al.

[11] Patent Number: 5,145,355

[45] Date of Patent: Sep. 8, 1992

[54] APPARATUS FOR ACTIVE MONITORING OF COMBUSTION INSTABILITY

[75] Inventors: Thierry Poinsot, Guyancourt; Francois Lacas, Antony; Jean Chambon, Massy; Denis Veynante, Antony; Arnaud-Christophe Trouve, Paris, all of France

[73] Assignee: Centre National de la Recherche Scientifique (CNRS), Paris, France

[21] Appl. No.: 686,881

[22] Filed: Apr. 17, 1991

Related U.S. Application Data

[63] Continuation of Ser. No. 370,004, Jun. 22, 1989, abandoned.

[30] Foreign Application Priority Data

Jun. 22, 1988 [FR] France ..... 88 08383
Mar. 6, 1989 [FR] France ..... 89 02902

[51] Int. Cl.[5] ..... F23N 5/16

[52] U.S. Cl. ..... 431/1; 431/12; 431/19; 431/75; 431/89; 431/90; 431/114

[58] Field of Search ..... 431/1, 12, 19, 89, 90, 431/114, 75

[56] References Cited

U.S. PATENT DOCUMENTS 4,043,742 8/1977 Egan et al. ..... 431/12

FOREIGN PATENT DOCUMENTS 941182 11/1963 United Kingdom .
1495015 12/1977 United Kingdom .
2042221 9/1980 United Kingdom .

OTHER PUBLICATIONS

Lang, W. et al. "Active control of combustion instability." Combust. Flame, 70(3) 281-9 1987.
French Search Report dated Feb. 21, 1989.

*Primary Examiner*—David L. Lacey
*Assistant Examiner*—David Redding
*Attorney, Agent, or Firm*—Cushman, Darby & Cushman

[57] ABSTRACT

An apparatus for controlling pressure instabilities in a combustion chamber. The apparatus includes a detector which detects combustion chamber pressure and outputs a signal indicative of that pressure. A controller then receives the output signal, delays it by a selectable amount of time, and outputs the resultant delayed signal to a pressure chamber device. The pressure chamber device controls the fuel pressure in a fuel line which supplies the combustion chamber. In some embodiments, this pressure chamber device is a cylindrical chamber with closed ends. The pressure chamber has inlet openings and outlet openings which are connected to the fuel line. In some embodiments the bottom of the pressure chamber device includes an elastic diaphragm activated by an electric signal from the controller. In some embodiments the controller involves a delay line for delaying the output signal from the detector.

8 Claims, 2 Drawing Sheets

APPARATUS FOR ACTIVE MONITORING OF COMBUSTION INSTABILITY

This is a continuation of application Ser. No. 07/370,004, filed on Jun. 22, 1989, which was abandoned upon the filing hereof.

BACKGROUND OF THE INVENTION

1. Field of the Invention

The present invention relates to an apparatus for active monitoring of combustion instability.

2. Background Information

Combustion instability is the term used for the high-amplitude oscillations that appear in the combustion chambers of equipment such as airplane motors, rocket motors, or industrial furnaces or burners. These oscillations are extremely harmful and can diminish the performance of the system, increase the noise produced, and even in certain cases cause the complete destruction of the chamber because of the vibration engendered.

A method for active monitoring of this instability is also known in which a microphone is used to detect the variations in pressure in the chamber. The microphone signal is processed by a microcomputer and sent to compression chambers comprising loudspeakers installed in the air supplying the flame upstream of the combustion chamber.

When the transfer function between the microphone signal and the loudspeaker is selected correctly, the combustion instability can be suppressed.

Although generally satisfactory, this method has the disadvantage of high energy consumption because of the large quantity of air to be excited, and also of being difficult to implement in terms of the monitoring apparatus.

SUMMARY OF THE INVENTION

The present invention seeks to overcome these above-described disadvantages.

To this end, the subject of the invention is, first, a method for active monitoring of combustion instability in a combustion chamber, in which the instability in the chamber is detected, characterized in that the flow of fuel injected into the chamber is modulated as a function of the instability detected.

The detection of the instability may for example comprise detecting the variations in pressure or the oscillations of the flame in the combustion chamber.

The modulation performed on the fuel output can be understood simply as a time lag with respect to the instability detected, or as a more-complex transfer function obtained with the aid of a microcomputer, which may be better adapted to the particular physical problem and moreover can have an autoadaptation function.

The fact that the fuel flow is modulated offers a certain number of advantages with respect to exciting the air upstream of the combustion chamber.

First, the flow to be modulated is much less, and hence the energy necessary for monitoring it is reduced.

Moreover, the excited fluid is often a liquid, which makes it easier to perform the method. Finally, the devices for monitoring the fuel flow are easier to use in industrial situations, because rate regulation is generally done via the fuel.

The present invention also involves an apparatus for performing the above method, characterized in that it includes detection means for detecting the instability in the combustion chamber, means for monitoring the flow of fuel injected into the chamber, and control means for controlling the monitoring means as a function of the instability detected.

The aforementioned detection means may for example include a microphone installed in the combustion chamber, or an optical sensor installed for detecting the oscillations of the flame in this chamber.

The monitoring means may comprise a loudspeaker mounted on the line for supplying fuel to the combustion chamber.

The control means may comprise a delay line, or may include a microcomputer capable of performing a more-complex transfer function.

In a preferred embodiment of the invention, the means for monitoring the fuel flow include a chamber, having at least one bottom wall comprising a diaphragm, and means for causing the diaphragm to vibrate in such a way as to change the volume in the chamber; a plurality of inlet and outlet openings is formed symmetrically radially in the lateral wall of the chamber.

Such monitoring means make it possible to avoid straining the acoustical modes of the cavity.

Furthermore, the chamber of variable volume is completely independent of the burner and can be installed a certain distance from it. Consequently its installation does not require any structural modification of the combustion chamber, nor does it vary either its characteristics or its performance.

The means making it possible to vibrate the diaphragm may comprise an electromagnetic device or any mechanical device capable of attaining the frequencies of instability of the flame, generally on the order of several hundred Hertz.

In a particular embodiment, the chamber has a shape that is symmetrical about an axis of revolution, such as a substantially cylindrical shape.

BRIEF DESCRIPTION OF THE DRAWINGS

One particular embodiment of the invention will now be described by way of non-limiting example, referring to the accompanying drawings, in which.

DETAILED DESCRIPTION OF THE PREFERRED EMBODIMENT

Figure 1:
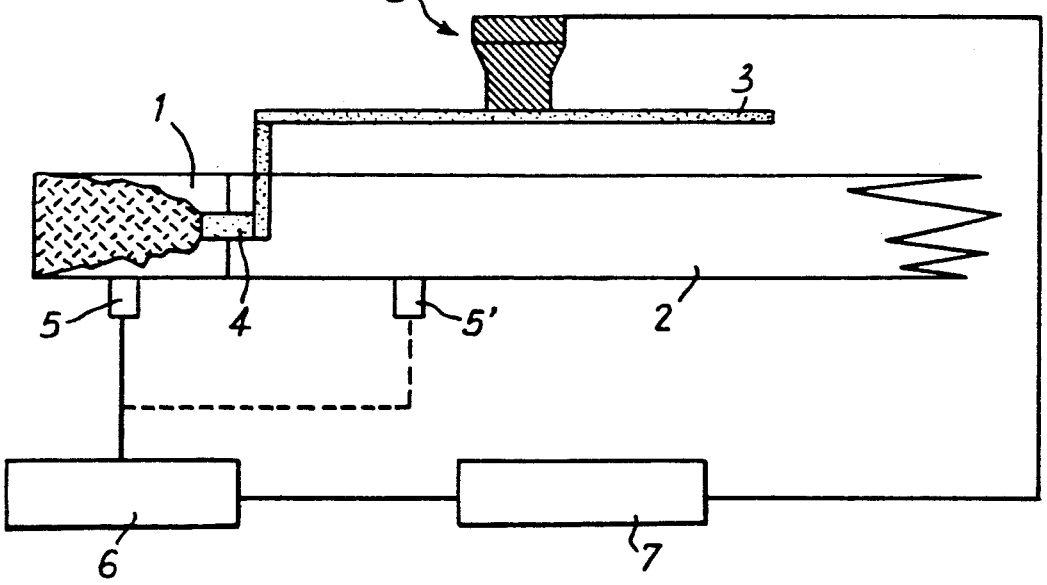
FIG. 1 is a schematic illustration of an apparatus according to the invention.

FIG. 1 shows a combustion chamber 1 supplied with air via a suction conduit 2 and fuel via a supply line 3 connected to a burner 4.

To suppress the combustion instability in the chamber 1, microphones 5, 5' are installed in this chamber and on the conduit 2, respectively, and are connected to control means 6 such as a delay line or a calculator, the output of which is applied to the input of an amplifier 7 controlling the flow monitoring means 8 mounted on the fuel supply line 3.

Figure 2:
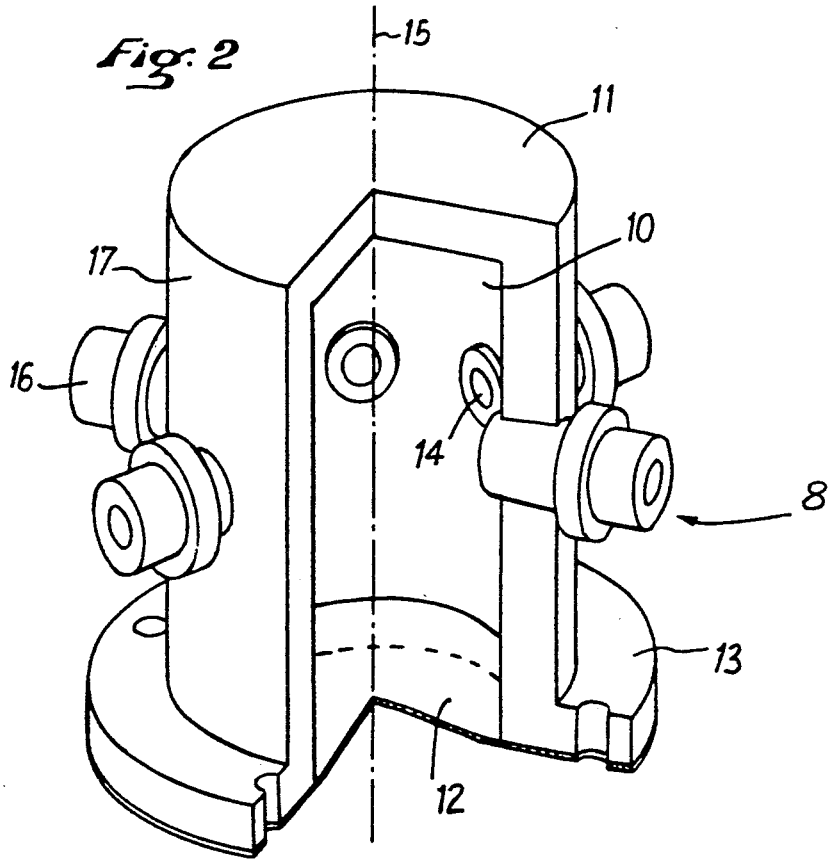
FIG. 2 is an exploded view of the chamber of variable volume.

The monitoring means 8 shown in FIG. 2 comprises an actuator forming a cylindrical chamber 10 having a rigid bottom wall 11 and another bottom wall 12 comprising an elastic diaphragm capable of vibrating under the influence of an electromagnet connected to the output of the amplifier 7.

A collar 13 enables the fixation of this diaphragm.

The arrival and departure of the fuel in the chamber 10 is effected by way of openings 14 distributed symmetrically with respect to the axis 15 of the chamber 10 in the same plane perpendicular to this axis.

These openings comprise radial nozzles 16 engaging the side wall 17 of the chamber.

In the example shown in FIG. 2, three fuel inlet nozzles and three fuel outlet nozzles have been provided, the inlet and outlet nozzles for example alternating with one another.

It will be understood that the inlet nozzles are all connected to the upstream portion of the supply line 3, while the outlet nozzles are all connected to the downstream portion of this line.

The oscillations detected by the microphone 5 are then transmitted to the supply line 3 by way of the control means 6, in such a manner as to modulate the flow of fuel injected into the chamber by the burner 4.

It has been possible to confirm that such an apparatus makes it possible to completely suppress the combustion instability in the case of a laminar burner.

Figure 3:
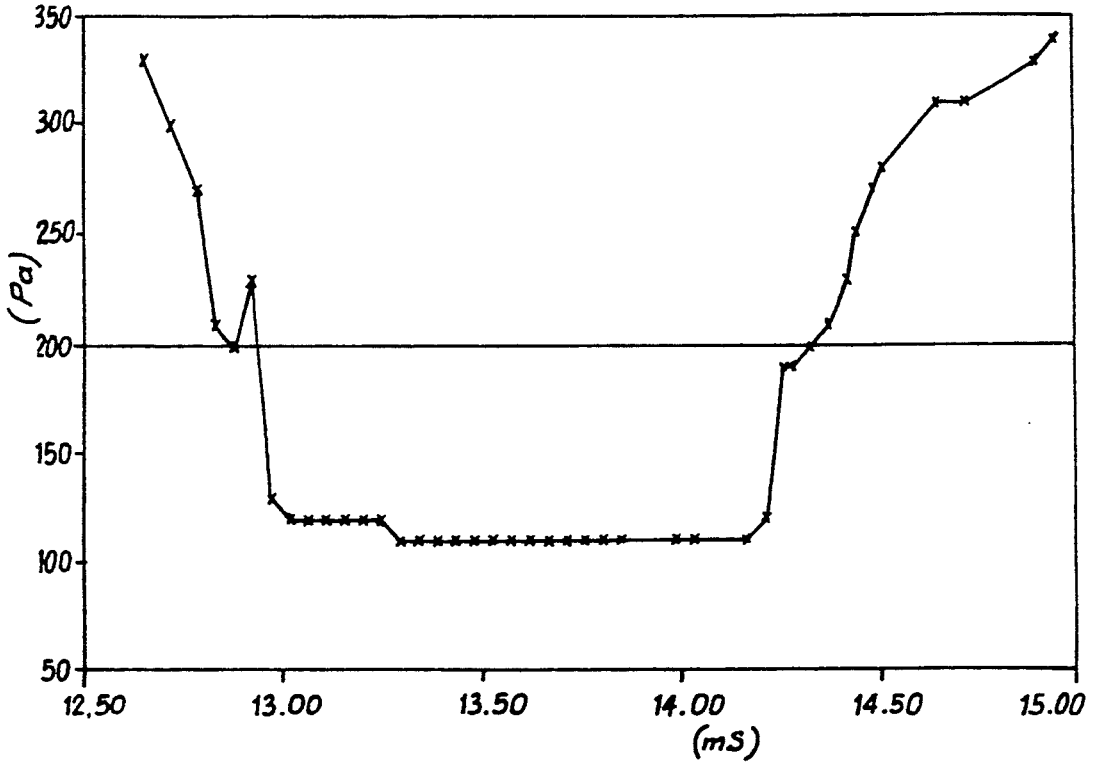
FIG. 3 is a diagram showing the results obtained with an apparatus of this type.

FIG. 3 shows the results obtained in the case of a turbulent burner.

This drawing shows the level of noise measured in Pascals as a function of the time lag in milliseconds applied via the delay line 6.

In the absence of a monitoring apparatus, the noise level was equal to 200 Pa (or approximately 140 dB), and the frequency of the instability was 280 Hz (or a period of 3.6 ms).

Contrarily, when the method according to the invention is implemented, the noise is reduced by half over a very wide range of phase displacement. This range (from 13 to 14.2 ms) corresponds to approximately one-third of the period of the phenomenon, and shows that the system is relatively insensitive to parameter variations.

In fact, a spectral analysis, not shown, demonstrates that although the residual noise is due to the turbulent combustion, the instability at 280 Hz has disappeared. Moreover, an observation of the combustion chamber by ultrarapid strioscopy (10,000 images per second) shows that the oscillations of the flames that were the source of the instability have also disappeared.

It has also been confirmed that the invention made it possible to extend the functional range of the burner, in particular toward very low power.

Various variants and modifications may of course be made to the foregoing description, without departing from the spirit or the scope of the invention.

In particular, other means for monitoring the fuel flow may be used, for example a rotary valve or a regulatable restriction in the conduit 3.

We claim:

1. A pressure controlling apparatus in combination with a burner which comprises a combustion chamber and a fuel supply line, said apparatus comprising:

detection means in said combustion chamber for issuing a signal representative of pressure instabilities in the combustion chamber, a pressure chamber means having an inlet opening connected to an upper portion of said fuel supply line and an outlet opening connected to a lower portion of said fuel supply line, the lower portion of said fuel supply line supplying fuel to said burner, the pressure chamber means also having a pressurizing means for varying the pressure in said lower portion of said fuel supply line, and control means for controlling the pressurizing means by delaying the signal issued from said detection means by a selectable period of time to generate a delayed signal, and by outputting said delayed signal to the pressurizing means.

2. The combination according to claim 1, wherein said detection means include a microphone mounted in the combustion chamber for detecting the pressure in said combustion chamber.

3. The combination according to claim 1, wherein said detection means include an optical sensor mounted for detecting the oscillations of the flame in the combustion chamber.

4. The combination according to claim 1, wherein said pressurizing means comprises a loudspeaker, having a membrane which forms a wall of said pressure chamber means and an electromagnet of which is connected to an output of said control means which outputs said delayed signal.

5. The combination according to claim 1, wherein said control means includes a delay line which provides said delaying of the signal issued from said detection means.

6. The combination according to claim 1, wherein said inlet opening and outlet opening are arranged symmetrically radially in a side wall of the pressure chamber means.

7. The combination according to claim 1, wherein said pressure chamber means is symmetrical about an longitudinal axis of rotation.

8. The combination according to claim 7, wherein said pressure chamber means is substantially cylindrical.

* * * * *